US006302718B1

(12) United States Patent
Kim

(10) Patent No.: US 6,302,718 B1
(45) Date of Patent: Oct. 16, 2001

(54) JACK WITH MICROSWITCH FOR DISTRIBUTING DIGITAL SIGNALS

(75) Inventor: Dongjoon Kim, Ansan (KR)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/408,034

(22) Filed: Sep. 29, 1999

(30) Foreign Application Priority Data

Sep. 29, 1998 (KR) ..... 98-40591

(51) Int. Cl.[7] ..... H01R 29/00
(52) U.S. Cl. ..... 439/188; 200/51.1
(58) Field of Search ..... 439/188, 189; 200/51.1

(56) References Cited

U.S. PATENT DOCUMENTS 5,246,378 * 9/1993 Seiceanu ..... 439/188
5,348,491 * 9/1994 Louwagie et al. ..... 439/188
5,382,173 * 1/1995 Brown et al. ..... 439/188
5,702,262 * 12/1997 Brown et al. ..... 439/188
5,964,607 * 10/1999 Finke et al. ..... 439/188

* cited by examiner

*Primary Examiner*—Tulsidas Patel
(74) *Attorney, Agent, or Firm*—Stacey E. Caldwell

(57) ABSTRACT

A jack for distributing digital signals for connection between network devices is provided. The jack includes a microswitch for switching electrical connection between two conducting wires and is constructed so to prevent poor contact between the switch and conducting wires. The jack includes a jack housing, a printed circuit board, plurality of conducting wires, a plurality of sleeves on the housing for receiving corresponding plugs therein, and a microswitch comprising a lever adapted to be actuated by a respective plug inserted into one of the sleeves, a push button adapted to be actuated by the lever, a first contact terminal connected at ordinary times, a second contact terminal disconnected at ordinary times, and a common terminal being connected to one of the first and second contact terminals for electrically connecting or disconnecting the conducting wires.

6 Claims, 3 Drawing Sheets

JACK WITH MICROSWITCH FOR DISTRIBUTING DIGITAL SIGNALS

FIELD OF THE INVENTION

The present invention relates to a jack for distributing digital signals and, more particularly, to a jack between network devices for digital signaling connection which includes a microswitch for electrically connecting and disconnecting the digital signals.

BACKGROUND OF THE INVENTION

In general, a transmission network for transmitting analog signals, digital voice signals or digital information is composed of a variety of complex connection devices. As the network environment is shifted to multimedia network, network-related techniques become extensive and networks are connected through complicated routes. Accordingly, devices in various forms are used to facilitate signal processing. Such devices are usually located in an area where a plurality of installations, such as telephone repeater stations, are placed, the installations being connected to each other through various methods including coaxial cables, microwaves and artificial satellites.

In a transmission network, one of the most important functions is to connect one device to another device. The connection of two devices is typically achieved by a first terminal device received by a plug, cable or other carrier, connected to another terminal device through another plug, cable or carrier. The connection device may include additional devices for monitoring or testing.

The cables of the network devices are connected by a jack which distributes the digital signals and electrically connects and disconnects the signals as they are processed. Such a jack typically includes a jack housing, a printed circuit board, conducting wires, a plurality of sleeves for receiving corresponding plugs, and a switch. The plugs at the ends of the connecting cables are inserted into the sleeves of the jack to connect the network devices to each other. A known configuration of a conventional jack for distributing digital signals for connecting network devices is described below. FIG. 1 illustrates the inner configuration of the conventional jack for distributing the digital signals, and FIG. 2 is an enlarged plan view of the switch of the conventional jack.

Referring to FIGS. 1 and 2, the conventional digital signal distributing jack 1 includes a plurality of sleeves 12 into which corresponding plugs 40 are inserted, sleeves 12 being assembled within a jack housing 10, a plurality of conducting wires 20 and 22 connected with plugs 40 when plugs 40 are inserted into sleeves 12, and a switch 30 assembled within jack housing 10 for electrically connecting or disconnecting conducting wires 20 and 22.

Conducting wires 20 and 22 are arranged within jack housing 10 for conducting electrical signals, and their ends extend to the center of sleeves 12. Switch 30 for electrically connecting or disconnecting conducting wires 20 and 22 is composed of a contact terminal 34 which is movably supported in a plate spring at the rear of a switch body 32 to allow its end to come into contact with conducting wires 20 and 22, and an elastic piece 36 which is elastically supported at both sides of the front of switch body 32, the end of elastic piece 36 coming into contact with one side of contact terminal 34, elastic piece 36 having a contact 36*a* at each side.

In the above-described configuration of a conventional jack, when elastic piece 36 is deflected by plug 40 during insertion of plug 40 into sleeve 12, contact terminal 34 is disconnected from conducting wires 20 and 22 by elastic piece 36. By doing so, electric connection between the two conducting wires 20 and 22 is cut off. In this switch configuration however, the restoring force of the contact terminal deteriorates over time as the plug is repeatedly inserted into the sleeve.

Specifically, the contact terminal is in contact with the conducting wires when the plug is not inserted into the sleeve and it is disconnected from the conducting wires when the plug is inserted. However, the restoring force of the contact terminal is weakened due to repeated insertion of the plug, which can allow the contact terminal to disconnect from the conducting wires even when the plug is not inserted. This unintentionally cuts off the electrical connection between the contact terminal and the switch and therefore interferes with the intended switching of the signals.

SUMMARY OF THE INVENTION

Accordingly, the present invention is directed to a jack for distributing digital signals that substantially obviates the above problems by solving the limitations and disadvantages of the prior art.

An object of the present invention therefore is to provide a jack for connection between network devices that distributes digital signals between conducting wires and which employs a microswitch for electrically connecting and disconnecting the conducting wires and which prevents poor contact between the switch and the conducting wires.

To accomplish this object, there is provided a jack for distributing digital signals which includes a jack housing, a plurality of conducting wires arranged within the jack housing, a plurality of sleeves assembled within the jack housing for receiving corresponding plugs inserted thereinto, and a microswitch mounted within the jack housing comprising a lever movable between an undeflected state and a deflected state and adapted to be deflected by a portion of the plug during insertion into its respective sleeve, a push button adapted to be actuated by the lever, a common terminal movable between a first position and a second position, a first contact terminal connected to the common terminal at its first position, and a second contact terminal connected to the common terminal at its second position.

Preferably, the number of microswitches in the jack corresponds to the number of conducting wires.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 2:
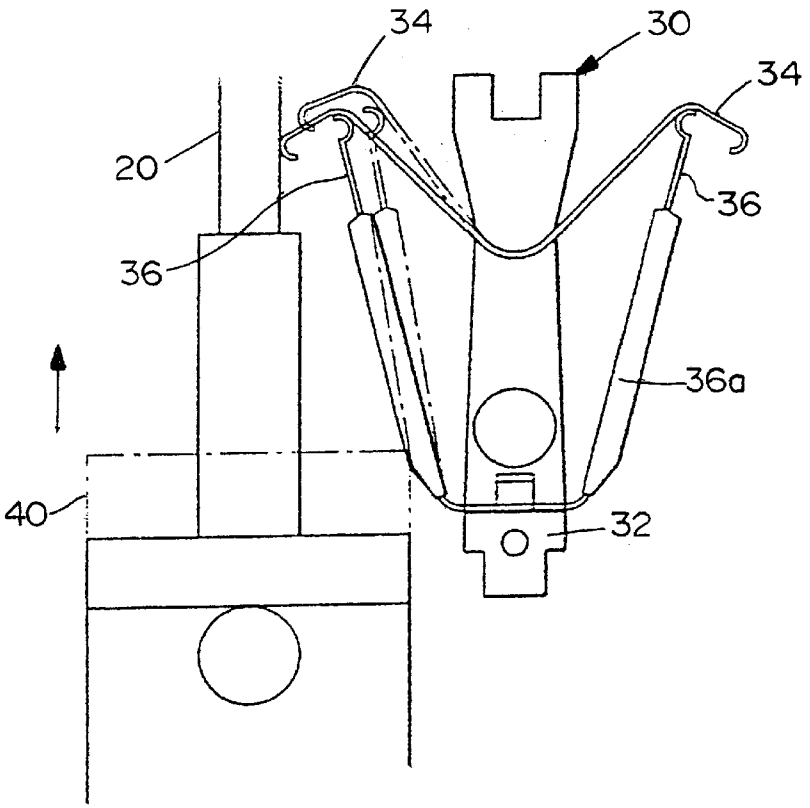
FIG.2 (PRIOR ART)
FIG. 2 is an extended plan view of the switch of the conventional jack for distributing digital signals.
Figure 1:
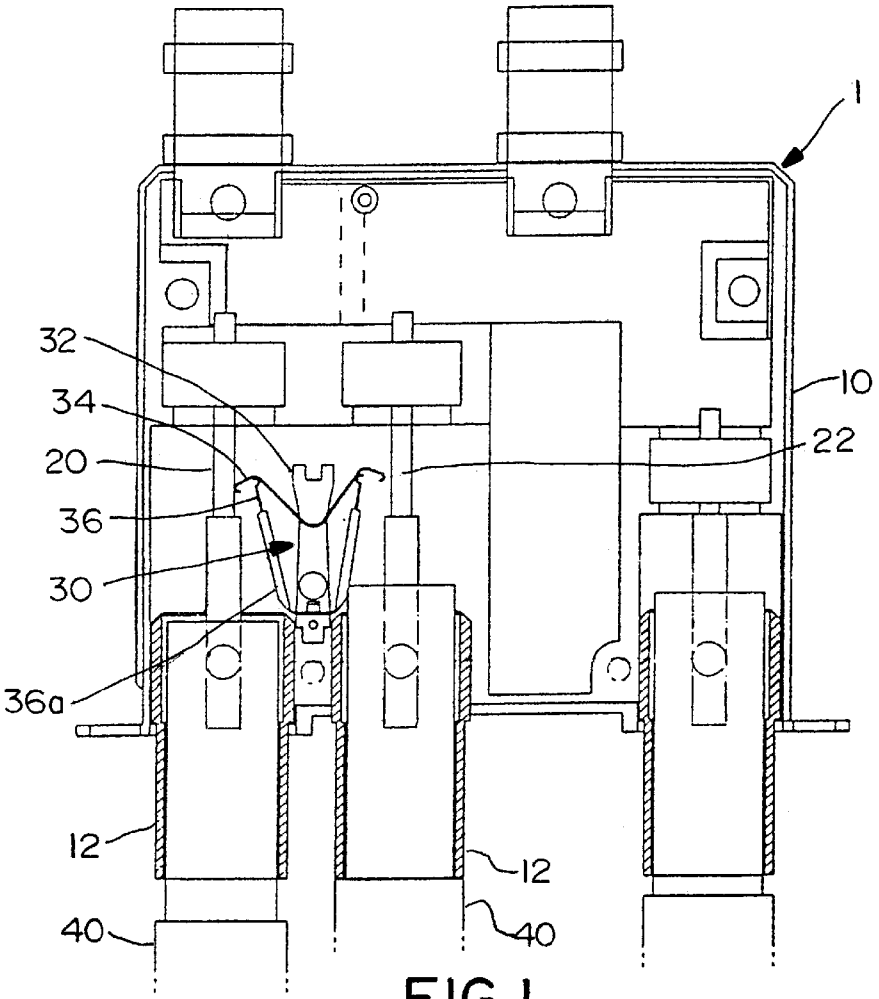
FIG.1 (PRIOR ART)
FIG. 1 illustrates the inner configuration of a conventional jack for distributing digital signals.
Figure 4:
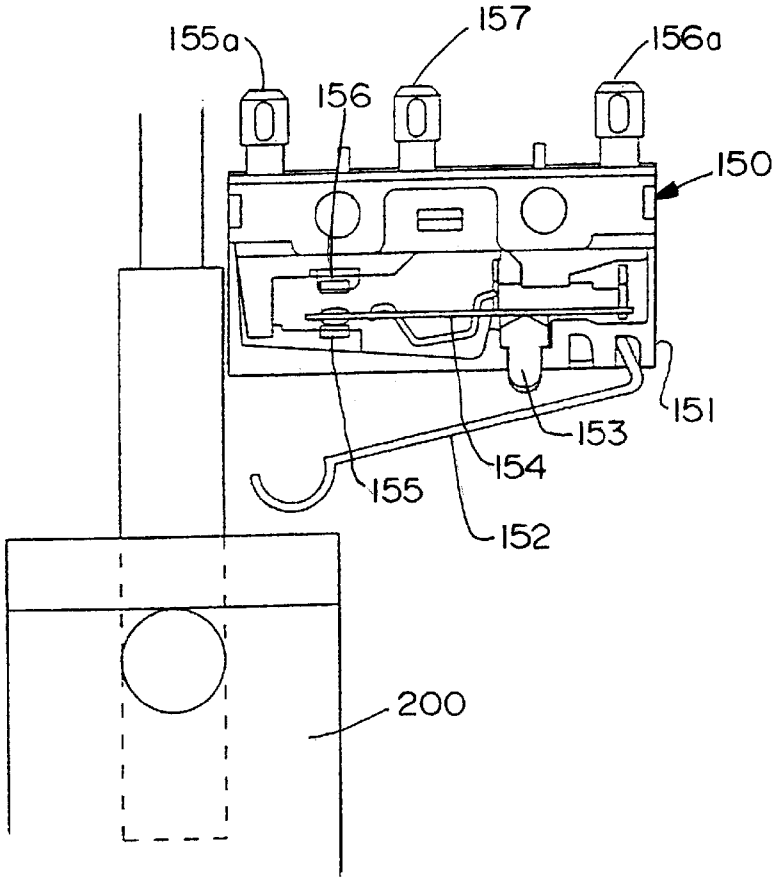
FIG. 4 is a plan view of the jack of the present invention illustrating the operation of the microswitch when the lever is in its undeflected state.
Figure 3:
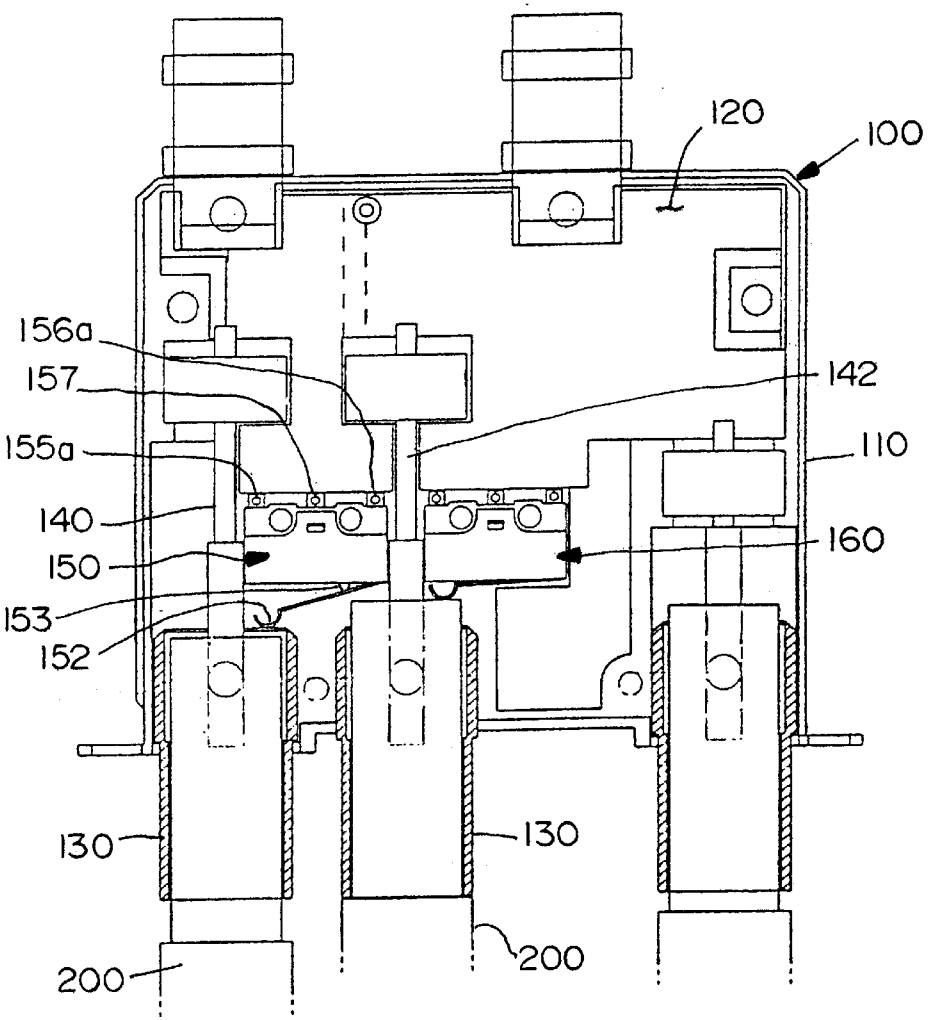
FIG. 3 illustrates the inner configuration of a jack for distributing digital signals according to the present invention.

Reference will now be made in detail to the preferred embodiment of the present invention, examples of which are illustrated in the accompanying drawings. FIG. 3 illustrates the inner configuration of a jack for distributing digital signals according to the present invention. FIG. 4 is a plan view roughly illustrating the operation of a microswitch when a plug inserted into the jack is not actuating the microswitch, and FIG. 5 is a plan view roughly illustrating the operation of the microswitch when the plug inserted into the jack is actuating the microswitch.

Figure 5:
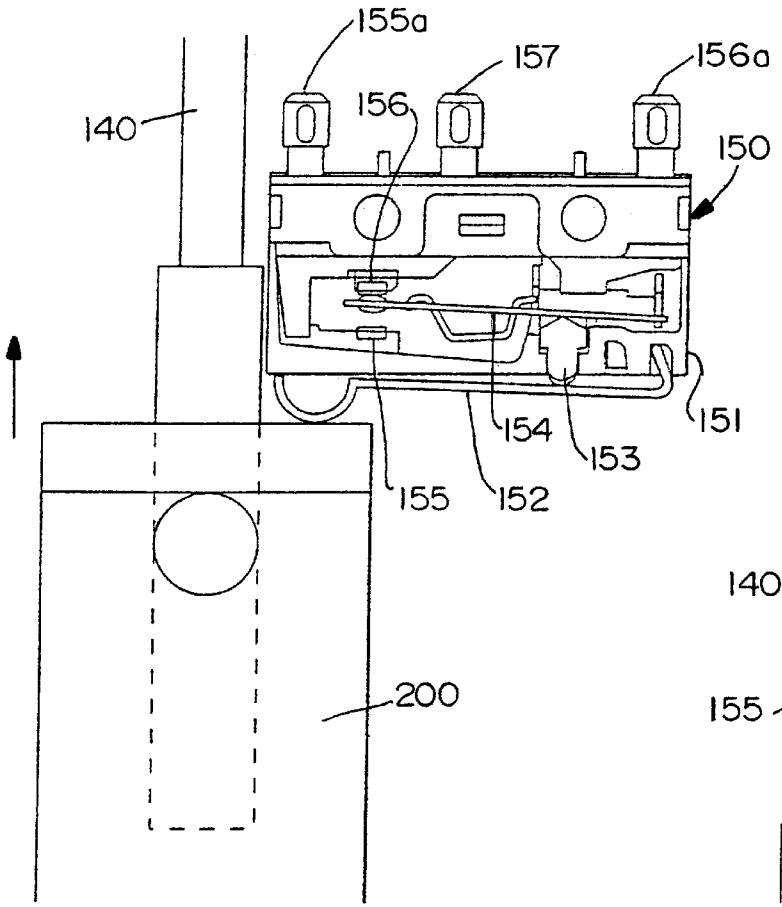
FIG. 5 is a plan view of the jack of the present invention illustrating the operation of the microswitch when the lever is in its deflected state.

Looking at FIGS. 3, 4, 5, and 6, an improved jack 100 for distributing or switching digital signals according to the present invention is disclosed having the configuration of switch 150 and its operation during insertion of plug 200. Switch 150, according to the present invention, is configured as a microswitch for connecting and disconnecting electrical contact between two adjacent wires 140 and 142 and comprises a lever 152 elastically-supported at an external side of a switch body 151. Lever 152 is movable between an undeflected state (FIG. 4) and a deflected state (FIG. 5). A push button 153 is adapted to be actuated by lever 152 when lever 152 is in its deflected state. A contact plate 154 is elastically-supported at an inner side of switch body 151 and is movable between a first position corresponding to the undeflected state of lever 152, and a second position corresponding to the deflected state of lever 152. Contact plate 154 is arranged so as to be actuated between the first and second positions by push button 153. A first contact 155 and a second contact 156 are mounted in switch body 151. Also, a first contact terminal 155*a* and a second contact terminal 156*a* are mounted on switch body 151.

Figure 6:
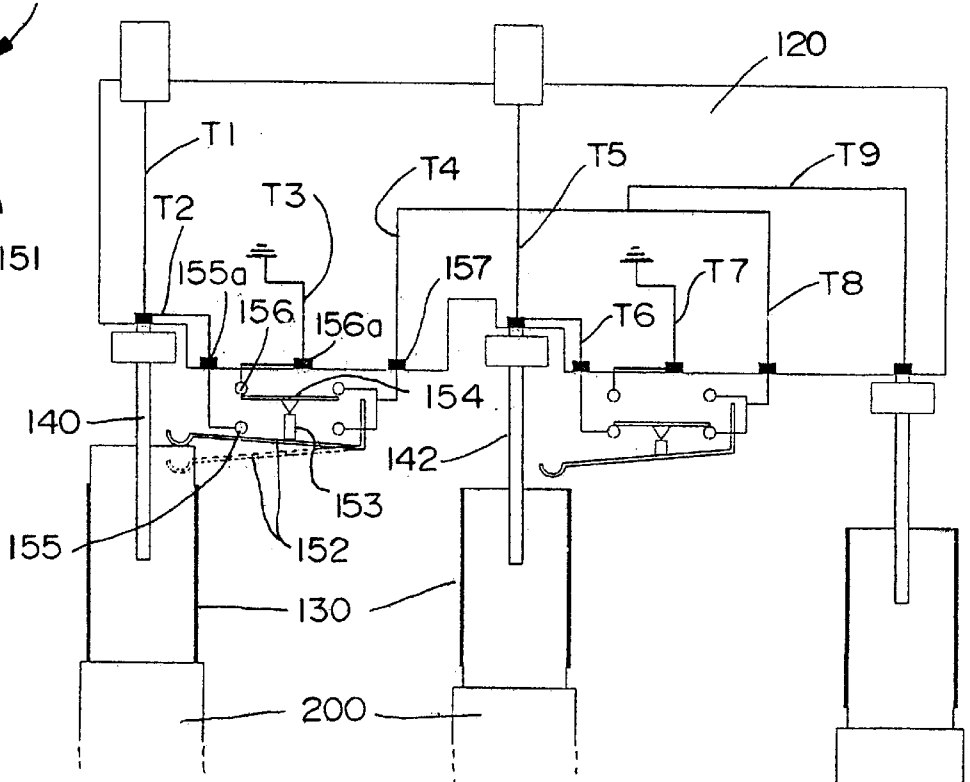

A printed circuit board 120 is mounted within jack housing 110 and electrically connects the parts constructing jack 100 to one another. Specifically, as seen in FIG. 6, microswitch 150 is electrically connected to printed circuit board 120 through first contact terminal 155*a*, second contact terminal 156*a* and common terminal 157. Also, as seen in FIG. 6, conducting wire 140 is electrically connected to first contact terminal 155*a* through circuit board 120, and conducting wire 142 is electrically connected to common terminal 157 through circuit board 120. Common terminal 157 is also electrically connected to contact plate 154 through printed circuit board 120. In addition, first contact 155 is electrically connected to first contact terminal 155*a* through printed circuit board 120 and second contact 156 is electrically connected to second contact terminal 156*a* through printed circuit board 120.

Referring to FIGS. 4 and 6, in the undeflected state of lever 152, contact plate 154 is in electrical contact with first contact 155. Thus, as common terminal 157 is electrically connected to contact plate 154 through printed circuit board 120, and as first contact 155 is electrically connected to first contact terminal 155*a* through printed circuit board 120, first contact terminal 155*a* is electrically connected to common terminal 157 when lever 152 is in an undeflected state. Therefore, as conducting wire 140 is electrically connected to first contact terminal 155*a* through circuit board 120, and as common terminal 157 is electrically connected to conducting wire 142 through printed circuit board 120, wires 140 and 142 are electrically connected through circuit board 120 and switch 150.

On the other hand, as seen in FIGS. 5 and 6, when contact plate 154 is actuated and pushed by push button 153 (i.e., when lever 152 is in its deflected state), as depicted in FIG. 5, first contact 155 is disconnected from contact plate 154 and second contact 156 is connected thereto. Thus, as common terminal 157 is electrically connected to contact plate 154 through printed circuit board 120, and as second contact 156 is electrically connected to second contact terminal 156*a* through printed circuit board 120, second contact terminal 156*a* is electrically connected to common terminal 157 when lever 152 is in a deflected state. Therefore, as conducting wire 140 is electrically connected to first contact terminal 155*a*, rather than to second contact terminal 156*a*, through circuit board 120, wires 140 and 142 are electrically disconnected from each other when lever 152 is in a deflected state. The electrical schematic, shown in FIG. 6, shows the electrical connections on printed circuit board 120, i.e., printed circuit board traces T1 through T9, between the elements in jack 100, showing in detail how microswitch 150 electrically responds to the insertion of plug 200.

Looking back to FIG. 3, jack 100 for distributing digital signals, which includes microswitch 150 of the present invention further includes a jack housing 110, a printed circuit board 120 mounted inside jack housing 110, a plurality of sleeves 130 assembled within jack housing 110 for receiving 30 a corresponding plurality of plugs 200, a plurality of conducting wires 140 and 142 arranged within jack housing 110, and microswitch 150 mounted on one side of printed circuit board 120 for electrically connecting and disconnecting conducting wires 140 and 142.

Jack housing 110 includes sleeves 130 integral with the housing for receiving corresponding plugs 200 of a cable (not shown) for connecting the network devices. As stated previously, printed circuit board 120, which electrically connects the parts constructing jack 100 to one another, is mounted within jack housing 110 and is electrically connected to conducting wires 140 and 142 and microswitch 150. The conducting wires 140 and 142 conduct the electrical signals and therefore electrically connect the network devices through the connection of the cables of connecting network devices. A microswitch 150 and 160 is located in the jack housing for each conducting wire 140 and 142, or however many conducting wires are utilized in the specific jack assembly.

That is, jack 100 according to the present invention includes jack housing 110, printed circuit board 120 mounted within jack housing 110, a plurality of conducting wires 140 and 142 arranged within jack housing 110 for conducting electrical signals, a plurality of sleeves 130 assembled within and integral with the housing for receiving corresponding plugs 200, and microswitches 150 and 160 each of which is composed of a lever 152 movable between an undeflected state and a deflected state and adapted to be actuated by a portion of a plug 200 inserted into a respective sleeve 130, push button 153 being pushed by lever 152 during its deflected state, a common terminal 157 for electrically connecting or disconnecting conducting wires 140 and 142 including a plate portion 154 movable between a first position and a second position, corresponding to the undeflected state and the deflected state, respectively, of lever 152, a first contact terminal 155*a* connected to the common terminal 157 when the plate 154 is in its first position, and second contact terminal 155*a* connected to the common terminal 157 when the plate 154 is in its second position. Microswitches 150 and 160 are switches for conducting wires 140 and 142, respectively, to electrically connect and disconnect them.

Referring to FIGS. 4 and 5, microswitch 150 according to the present invention is constructed in such a manner that, when plug 200 is inserted into sleeve 130 and moves lever 152 from its undeflected to its deflected state, push button 153 is pushed by lever 152 to move contact plate 154 from first contact 155 to second contact 156. This cuts off electrical connection of the two conducting wires 140 and 142. On the other hand, when plug 200 is removed from sleeve 130, the force pressing lever 152 disappears and the lever moves to its undeflected state to restore contact plate 154 to its first position, resulting in connection of contact plate 154 and first contact 155. Accordingly, two conducting wires 140 and 142 are electrically connected.

In the configuration of microswitch 150 of the present invention, common terminal 157 is connected to the first contact terminal 155 when the terminal plate is in its first position, and common terminal 157 is connected to the second contact terminal 156 when the terminal plate is in its second position, thereby electrically connecting or disconnecting the two wires 140 and 142. As described above, contact plate 154 of microswitch 150 allows common terminal 157 to be connected to one of the first and second contact terminals 155 and 156, and alleviates the degradation of the switch that occurred in the prior art. Furthermore, jack 100 can perform repeated operations, as much as 10,000 cycles, without compromising the integrity of the switch contacts.

According to the present invention therefore, microswitch 150 functions to electrically connect and disconnect the conducting wires of the jack and therefore distribute the digital signals in an improved manner.

It will be apparent to those skilled in the art that various modifications and variations can be made in the jack of the present invention without departing from the spirit or scope of the invention. Thus, it is intended that the present invention cover the modifications and variations of this invention provided they come within the scope of the appended claims and their equivalents.

I claim:

1. A jack for distributing digital signals, comprising:

a jack housing;

a plurality of conducting wires mounted within the jack housing for conducting electric signals;

a plurality of plug-receiving sleeves integral with the jack housing, each adapted to receive a corresponding plug; and a microswitch mounted within the jack housing, including a lever movable between a deflected state and an undeflected state and adapted to be actuated by a portion of the corresponding plug, a common terminal including a terminal plate movable between a first position and a second position, a first contact terminal connected to the terminal plate at its first position, a second contact terminal connected to the terminal plate at its second position, and a push button adapted to be actuated by the lever when the lever is in its deflected state.

2. The jack for distributing digital signals as set forth in claim 1, wherein the first position of the terminal plate corresponds to the undeflected state of the lever, and the second position of the terminal plate corresponds to the deflected state of the lever.

3. The jack for distributing digital signals as set forth in claim 1, wherein the lever contacts the push button when the lever is in its deflected state, and the push button moves the contact plate to its second position.

4. The jack for distributing digital signals as set forth in claim 1, including a plurality of microswitches, wherein the number of the microswitches in the jack corresponds to the number of conducting wires.

5. A microswitch for electrically connecting digital signals through conductive wires comprising:

a lever movable between a deflected state and an undeflected state;

a push button adapted to be actuated by the lever when the lever is in its deflected state;

a common terminal including a terminal plate movable between a first position and a second position;

a first contact terminal connected to the terminal plate at its first position; and a second contact terminal connected to the terminal plate at its second position, wherein the push button moves the terminal plate to its second position.

6. The microswitch as set forth in claim 5 wherein the first position of the terminal plate corresponds to the undeflected state of the lever, and the second position of the terminal plate corresponds to the deflected state of the lever.

* * * * *